US007905056B2

(12) United States Patent
Kornfield

(10) Patent No.: US 7,905,056 B2
(45) Date of Patent: Mar. 15, 2011

(54) SYSTEM AND METHOD FOR TRANSFERRING SHEAR FORCES IN GARAGE DOOR OPENINGS

(75) Inventor: Laurence M. Kornfield, San Francisco, CA (US)

(73) Assignee: The City and County of San Francisco, San Francisco, CA (US)

( * ) Notice: Subject to any disclaimer, the term of this patent is extended or adjusted under 35 U.S.C. 154(b) by 533 days.

(21) Appl. No.: 11/604,084

(22) Filed: Nov. 22, 2006

(65) Prior Publication Data

US 2007/0261314 A1 Nov. 15, 2007

Related U.S. Application Data

(60) Provisional application No. 60/797,147, filed on May 2, 2006.

(51) Int. Cl.
*E05D 15/38* (2006.01)

(52) U.S. Cl. ..... 49/197; 160/201; 49/449; 16/DIG. 1; 16/DIG. 6

(58) Field of Classification Search ..... 49/449, 49/176, 182, 181, 187, 394, 197, 198; 160/201, 160/209; 16/DIG. 1, DIG. 6
See application file for complete search history.

(56) References Cited

U.S. PATENT DOCUMENTS

| | | | | | |
|---|---|---|---|---|---|
| 2,124,969 | A * | 7/1938 | Bagley et al. | 160/209 |
| 2,209,041 | A * | 7/1940 | Sinchuk | 49/437 |
| 2,359,101 | A * | 9/1944 | Flynn | 292/288 |
| 3,443,625 | A * | 5/1969 | Moser et al. | 160/181 |
| 5,048,243 | A * | 9/1991 | Ward | 52/167.4 |
| 5,146,724 | A * | 9/1992 | Angelo | 52/299 |
| 5,331,786 | A * | 7/1994 | Lippert | 52/167.3 |
| 5,584,332 | A * | 12/1996 | Miller | 160/201 |
| 6,112,799 | A * | 9/2000 | Mullet et al. | 160/201 |
| 6,363,659 | B1 * | 4/2002 | Wang | 49/183 |
| 6,374,551 | B1 * | 4/2002 | Boilen et al. | 52/167.3 |
| 6,442,897 | B1 * | 9/2002 | Mullet | 49/199 |
| 2002/0108325 | A1 * | 8/2002 | Hulls et al. | 52/204.1 |
| 2005/0155301 | A1 * | 7/2005 | Hapka et al. | 52/210 |

* cited by examiner

*Primary Examiner* — Katherine Mitchell
*Assistant Examiner* — Daniel Cahn
(74) *Attorney, Agent, or Firm* — Dergosits & Noah LLP

(57) ABSTRACT

Brackets mounted to the corners of a garage door improve the strength of a garage structure in the event of an earthquake. As the garage sways during the earthquake, the door frame contacts the brackets mounted at the upper corners of the door. The brackets transfer shear forces from the frame to the door. Additional brackets mounted at the bottom corners of the door contact the lower portions of the frame and stop the horizontal movement of the garage door. By using the door to transfer the shear forces, the strength of the garage door frame is substantially improved.

11 Claims, 7 Drawing Sheets

SYSTEM AND METHOD FOR TRANSFERRING SHEAR FORCES IN GARAGE DOOR OPENINGS

CROSS REFERENCE TO RELATED APPLICATIONS

The present application claims priority to U.S. Provisional Patent Application No. 60/797,147, "System And Method For Transferring Shear Forces In Garage Door Openings" filed May 2, 2006.

BACKGROUND

During earthquakes, large man made structures such as houses are frequently damaged and collapse as a result of the structural damage caused by the earthquake ground movement. People trapped in the fallen structures are often severely injured or killed. While many newer structures are built to withstand earthquakes up to a certain predicted magnitude, many other existing structures must be retrofitted with additional support to prevent failure in the event of a large earthquake.

An area of particular weakness is the garage door, which is typically a large rectangular opening in the wall of the garage structure. The door normally includes a frame that has two side posts and a horizontal member that spans the two posts. The space between the posts must provide enough space to drive one or more cars through. The door area is weak because of this large unsupported opening. In contrast, the walls of the garage may comprise closely spaced posts and beams or may even be solid materials such as poured concrete.

The garage door itself typically is positioned behind the door frame and is attached to an opening mechanism such as a track or beam actuator. During a large earthquake, the top of the door frame sways from side to side while the base is typically bound to the foundation and does not move. Because the door is behind the door frame, both will move independently during the earthquake and the door will not provide any structural support for the door frame.

The door frame is particularly vulnerable to the earthquake movement that is in line with the plane of the frame. As the ground moves below the garage, the posts of the door frame sway which causes stress at the upper corners of the door frame. If the corners of the frame are broken, the frame can easily collapse. Because of this inherent weakness, garage door frame need to be heavily reinforced to prevent failure during a strong earthquake. Unfortunately, many garage doors are not reinforced and are susceptible to failure during an earthquake. What is needed is a system that improves the strength of the garage door frame that can be retrofitted onto existing garage doors.

SUMMARY OF THE INVENTION

The inventive system improves the structural strength of a garage door frame in the event of an earthquake. During an earthquake, the garage door frame sways in response to the ground movement. The garage door is typically mounted behind the door frame and does not provide strength to the frame or garage structure. The inventive system uses coupling mechanisms to attach the garage door to the garage door frame during the earthquake. This allows the strength of the door to be transferred to the frame which significantly enhances the strength of the garage door frame and may prevent the collapse of the garage structure.

In an embodiment, the inventive system uses "L" brackets mounted to the corners of the garage door with a planar portion extending forward into the plane of the door frame. The planar portions are parallel to the frame posts closely spaced to the inner edges. While the garage is stationary, there is no contact between the brackets and the door frame and the garage door can be opened and closed normally by sliding along tracks that extend into the ceiling. During an earthquake, the door frame will sway from side to side with the upper posts of the frame alternately moving towards the door and away from the door and the lower posts remaining stationary in the foundation. When a post moves towards the door it contacts the upper bracket which transfers the shear force to the door and helps to stop the swaying movement of the post. In a larger earthquake, the upper post movement may cause the door to slide horizontally and the lower brackets may contact the lower frame posts to further resist the movement of the posts.

When the brackets at opposite corners of the frame the door simultaneously contacts the frame posts, the door is compressed and provides shear strength to the door frame. A solid door transfers the shear force through the door structure which may be reinforced with structural diagonal members. A panel or sectional door will transfer the shear forces from the upper panel to the lower panels through the hinges that connect the panels. The panel or sectional door and other door types may be reinforced with flexible members such as wires or cables that are coupled to opposite corners of the door. When a shear force is applied to the door, one of the flexible members mounted will be pulled tight and will provide tension resistance to shear deformation of the door.

In other embodiments, the coupling mechanisms may reduce or prevent vertical movement between the door and frame. The coupling mechanism may use brackets that have holes that engage protrusions extending inward from the door frame. When an upper post sways towards the door in an earthquake, one or more protrusions engage corresponding holes in the brackets mounted to the door. The right beam of the frame moves towards the door to engage the holes in the upper right brackets while the protrusions in the left beam move away from the door and are free from the holes in the upper left bracket. As the garage sways back in the opposite direction, the protrusions in the left beam engage the holes in the upper left bracket while the protrusions in the right beam are freed. The coupling mechanism prevents vertical movement between the door and frame and transfers vertical forces from the post to the door. This vertical coupling further improves the strength of the door frame.

In another embodiment, the door to frame coupling mechanism includes plates having a series of ramped surfaces. These ramped plates are mounted to the corners of the door and the corresponding inner surfaces of the door frame. The ramped surfaces are configured to face each other and become coupled to each other in the same way as the protrusion/hole mechanism described above. While the protrusion and hole embodiment resists all vertical and inward horizontal forces, the ramped surfaces may only transfer downward vertical forces and inward horizontal forces from the frame to the door. The ramped surfaces may require less alignment of the door within the frame and also release or decouple more easily that the protrusion/hole embodiment.

Alternatively, the inventive system may actuate a coupling mechanism to lock the door to the door frame when it is in its closed position. In an embodiment, the inventive system uses the brackets with holes that are mounted at the upper corners of the garage door. When the door is closed or when an earthquake is detected, the system actuates rods that extend inward from the frame through the holes in the brackets. The coupling mechanisms remain engaged to the garage door throughout the earthquake. The coupling mechanisms remain engaged until the system is reset. This engagement of both corners further improves the transfer of strength from the door to the frame and enhances the earthquake resistance of the garage.

DETAILED DESCRIPTION

The present invention is a device and system for improving the structural strength of a garage door. In the event of an earthquake, the ground will move which causes the garage to sway. This swaying force is increased in proportion to the height of the structure. The movement is typically horizontal and absorbed by the vertical beams in the structure. If the beams fail, the structure can collapse. The garage door frame is an area of weakness because the large opening requires the vertical posts to be spaced far apart and must support much higher loads than a normal wall posts. Similarly, the beam that spans the garage posts must also support higher loads than a cross beam in a normal wall.

Figure 1:
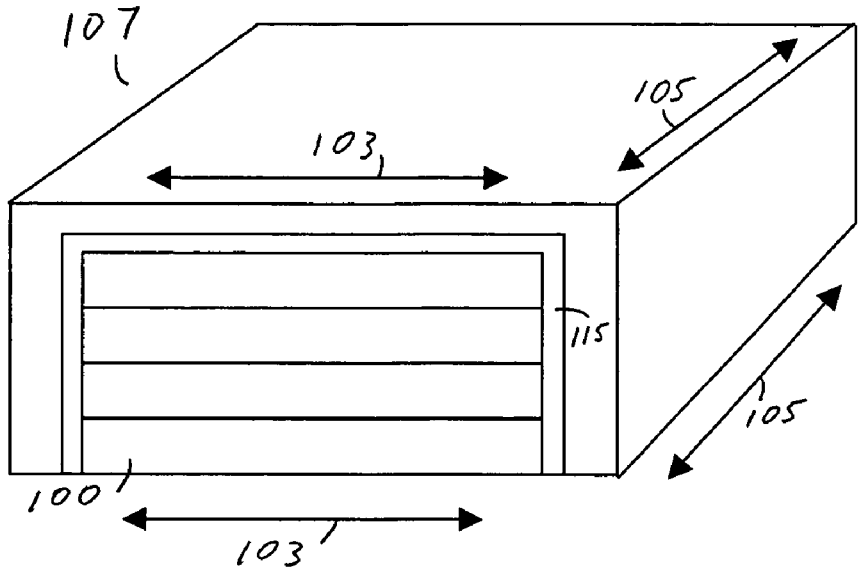
FIG. 1 illustrates the movement of a garage in an earthquake.

FIG. 1 illustrates forces that are applied to the inventive garage door during an earthquake. The ground shakes in the plane of the earth surface and may be represented by movement in both the X-direction 103 and Y-direction 105. As the ground shakes, the garage 107 responds by also shaking. The garage 107 is typically a heavy structure that responds to the earthquake by also moving in the X-direction 103 and Y-direction 105. A horizontal force in one direction applied to the upper edge of the door frame 115 which is applied to upper edge of the door 100 and opposed by a force in the opposite direction applied to the bottom edge of the door 100. The ability to oppose this force is known as the shear strength. The shear strength can also be thought of as the resistance to diagonal forces that are applied between the opposite corners of the door 100. A force towards the left applied to the top of the door 100 is transmitted through the door to the bottom surface. In order for the door 100 to support the door frame 115, the bottom of the door 100 resists horizontal movement within the door frame 115.

Figure 2:
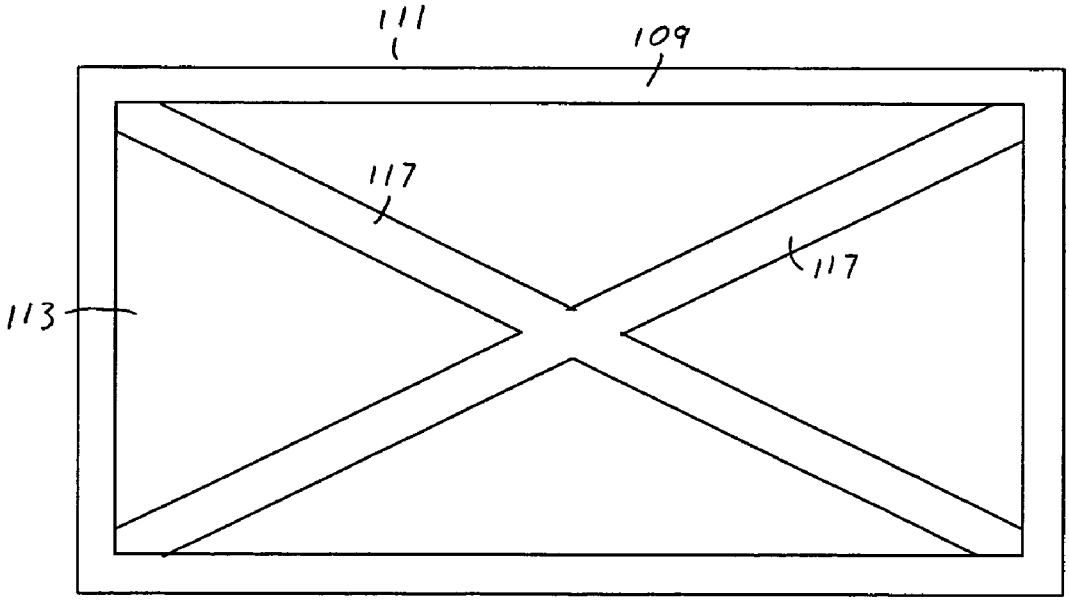
FIG. 2 illustrates a solid garage door.

There are many types of garage doors. With reference to FIG. 2, some doors are solid structures that are generally mounted within the door frame 115 so that the planar strength can be used to support the door frame 109. These solid doors 111 typically have a single solid layer 113 of material that spans the entire door surface. In an earthquake the horizontal shear force is distributed across the solid layer 113 through the height of the door 111. A solid door 111 may be further strengthened by attaching the solid layer 113 to a support members 109 that runs along the perimeter of the door 111 and cross beams 117 that run between opposite corners of the door 111.

A stronger door 111 will result in more support for the door frame 115 and the garage 107 in an earthquake. Because these cross beams 117 are aligned with the shear forces they are able to enhance the shear strength of the door 111. This strengthening will also cause the door 111 to be much heavier making it more difficult to open and close. The perimeter members 109 and cross beams 117 of the door also resist the horizontal shear forces in compression as the upper edge of the frame 115 sways from side to side. Thus, the solid door 101 is strong in shear and can provide resistance against horizontal forces directed in opposite directions.

Figure 3:
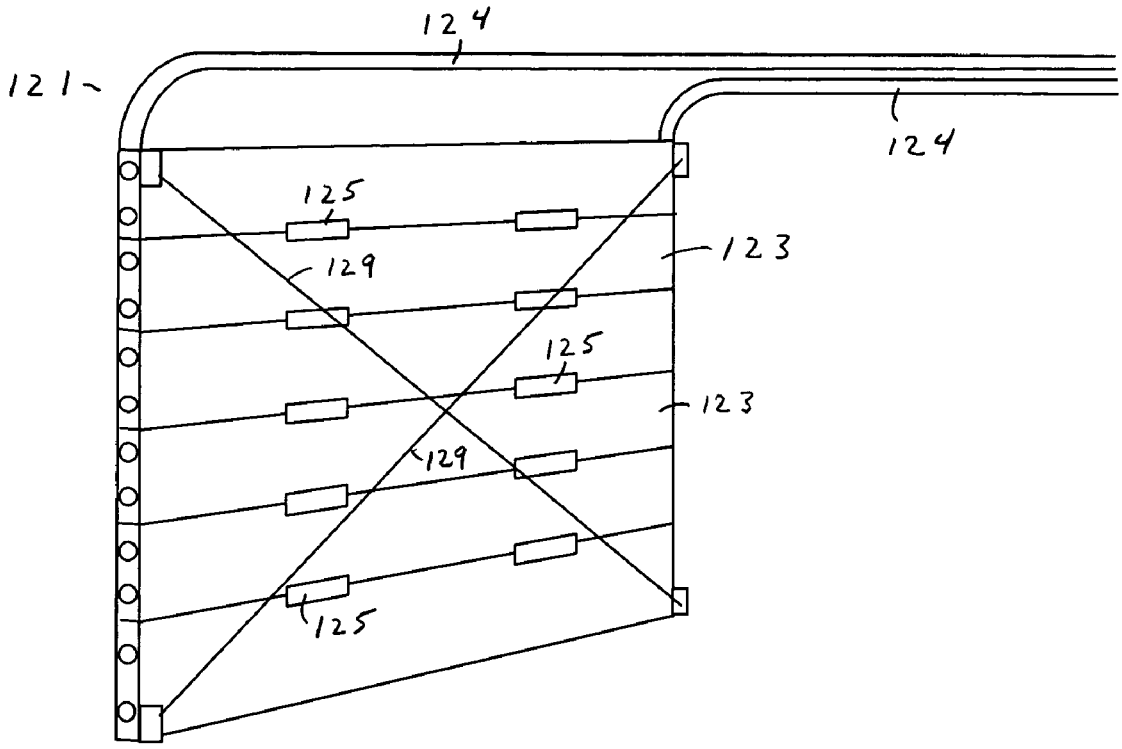
FIG. 3 illustrates a panel or sectional garage door.

Another type of garage door are panel or sectional doors. With reference to FIG. 3, the panel or sectional door 121 is typically made of many horizontal planar panels 123 that are coupled together with hinges 125 that allow the door 121 to travel along a track 124 mounted behind the frame into an open space in the ceiling. The panel or sectional door 121 is flexible out-of-plane at the bending sections hinges 125 but has strength in the plane of the door 121 when it is closed. If the horizontal force is applied to the top panel, the force is transmitted sequentially through the hinges 125 to the adjacent lower panels. The hinges 125 typically allow for some horizontal movement, thus all of panels 123 will shift towards the left until the hinge 125 will not allow any additional movement.

There are also many ways for reinforcing the panel or sectional garage door 121 to improve its resistance to shear forces. Because the perimeter 115 and cross beam 117 members are not be flexible discussed with reference to FIG. 2 are not flexible, they are unsuitable for use with panel or sectional doors that roll or slide along curved tracks. Wire, rod or cable members 129 that are run diagonally across the door 121 and attached to the opposite corners may be used to support a panel or sectional door 121 in order to oppose shear forces. These flexible members 129 are tight when the door 121 is closed and able to resist tensile forces but will not provide strength in compression. In the example above, when the top panel 123 shifts horizontally to the left out of vertical alignment, the members 129 running between the upper left and lower right corners will be pulled tight and will prevent additional horizontal movement. Similarly, members 129 mounted to the opposite corners between the upper right and lower left corners will prevent horizontal movement in the opposite direction. These members 129 may be attached to the inner surface of the door so that when the door 121 is opened, the bending at the hinges 125 will shorten the distance between the corners providing slack to the members 119. Thus, the members 129 can bend with the door 121 as it slides into the overhead track.

A problem with panel or sectional garage doors 121 as shown in FIG. 3 is that the tracks 124 that hold the door 121 are generally mounted behind the door frame 115 and is not rigidly attached to the door frame 115 in a secure structural manner. Thus, even if the door 121 is strong in shear strength, it may not provide any structural support to the garage 107 structure. In an earthquake, the door tracks 124 may easily bend away from the door frame 115 so that the door move independently from the garage structure. Once separated, the shear strength of the door 121 does not help to prevent failure of the garage door frame 109 and the garage 107 structure as shown in FIG. 1. The garage door tracks 124 can be more securely attached to the frame 115, however a simpler method for improving the strength would be to couple the door frame 115 to the door 121 during an earthquake.

The inventive system improves the strength of the garage 107 by coupling the panel or sectional door 121 to the door frame 115 during an earthquake. This coupling is particularly useful with panel or sectional doors 121 but may also be used to keep the solid door 111 within the door frame 115 and to reduce horizontal motion during the earthquake. The door frame 115 by itself is normally fairly weak in shear strength because the frame 115 spans a large open area and has weak connections at the post-to-beam location. However, when the door 121 is closed and physically coupled to the frame 115, the shear strength is dramatically enhanced. In an embodiment, the door 121 supports the door frame 115 with coupling mechanisms mounted at each of four corners. These coupling mechanisms strengthen the frame 115 by attaching the door 121 to the structure in order to resist shear forces that are applied to the door frame 115 during an earthquake.

The inventive reinforcement system is particularly useful with panel or sectional garage doors 121 that slide through tracks 124 that are loosely mounted behind the plane of the door frame 115. The tracks 124 guide the door 121 but do not provide any significant strength to the garage door frame 115. In an earthquake, the tracks are easily bent away from the door frame 115. Door 121 will move independently of the garage door frame 115 and does not provide any structural support to the garage 107.

There are various ways to modify the door 121 to support the door frame 115. These support devices should provide a temporary support mechanism that can be released so that the door 121 can easily be opened when access to the garage 107 is needed. In some embodiments, the support device may only be engaged when there is ground movement from an earthquake. In other embodiments, the support device may also include a coupling mechanism that has a coupled setting that locks the door to the frame and an uncoupled setting that releases the door 121 from the frame 115. This mechanism may be manually actuated or automatically triggered in the event of an earthquake.

Figure 4:
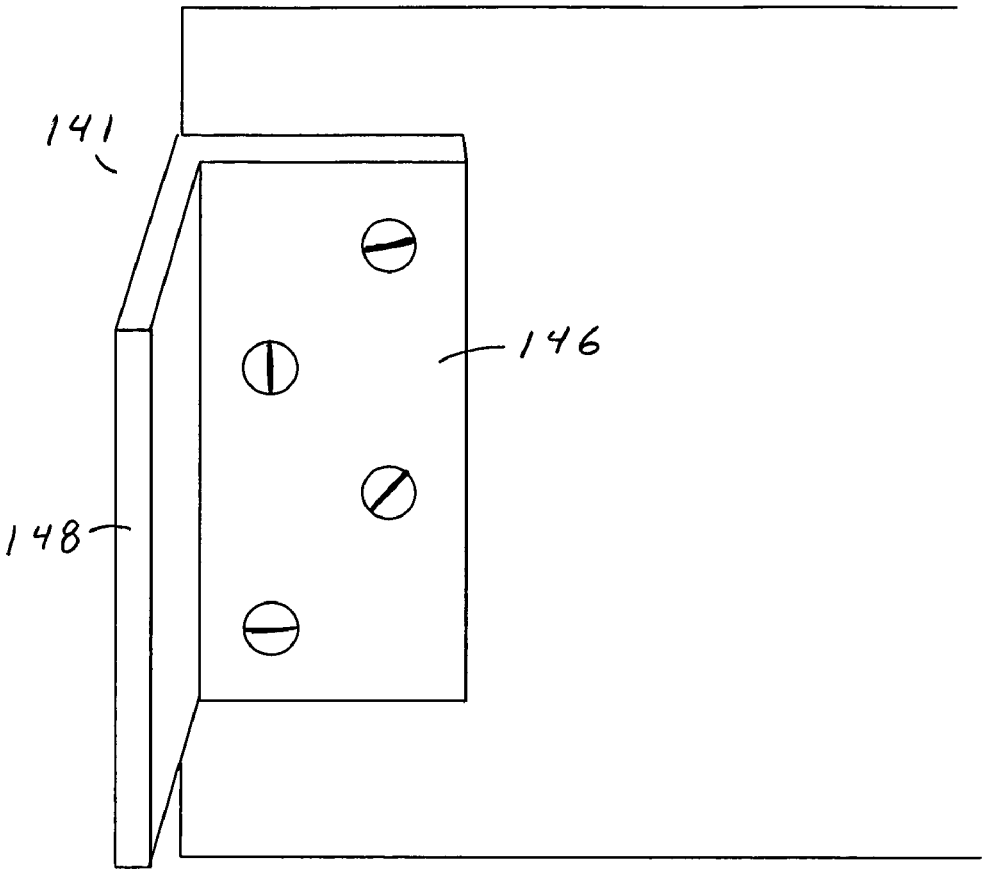
FIG. 4 illustrates an "L" bracket.

FIG. 4 illustrates an "L" bracket 141 that is used with the present invention. The bracket 141 has a mounting surface 146 which is attached to the door 121 and an extended portion 148 which is perpendicular but not attached to the frame 143. The mounting surface 146 maybe attached to the door with screws, bolts, slotted fittings or any other fastener. The mounting surface 146 may be welded to a compatible metal door or attached with an adhesive or any other secure adhesive means. The extended portion 148 provides a contact surface that transfers force from the contact to the door 121 in the event of an earthquake. Although the contact surface 148 is shown as being planar, it may have various alternative surfaces as described below.

Figure 5:
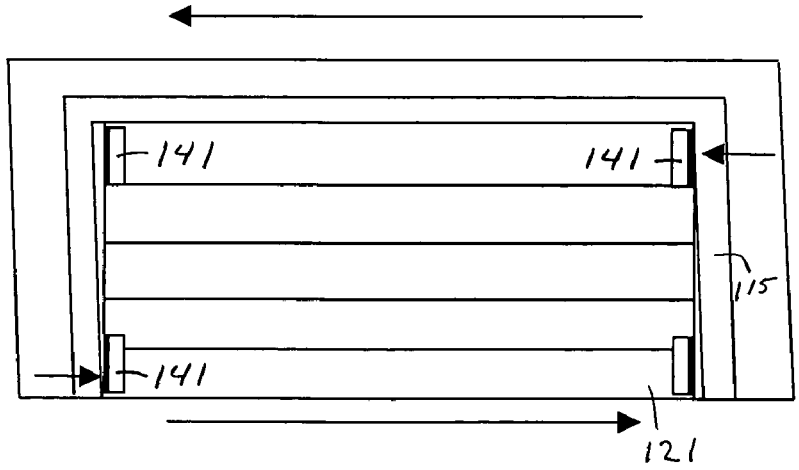
FIG. 5 illustrates a panel or sectional garage door with brackets.

For example, with reference to FIG. 5, in a first embodiment, the support device is a plurality of L brackets 141 that are mounted to garage door 121 at the four corners adjacent to the frame 115 when the door is closed. Because these brackets 141 are not attached to the frame 115, the garage door 121 opens and closes normally while the structure is stationary. In an embodiment, the brackets 141 are positioned so that one planar surface is attached to the door 121 and the perpendicular surfaces protrude forward into the plane of the door frame 115. The protruding sections of the brackets 141 have planar surfaces that are parallel to the frame 115. During an earthquake, the garage structure shakes as the ground moves. The door frame 115 is susceptible to movement in line with the plane of the frame. As the garage moves, the garage and door frame sway together. One side of frame 115 sways inward towards the door 121 and then away from the door 121 in the opposite outward direction.

When the frame 115 sways towards the left, the right side of the frame 115 moves inward and contacts the bracket 141 at the upper right side of the door 121. The bracket 141 and door 121 resist the inward movement of the right side of frame 115 and are therefore able to strengthen the door frame 115. In a strong earthquake, the force of the frame 115 against the bracket 141 may cause the door 121 to slide to the left side of the frame 115. When the door 121 moves to the left, the bracket 141 at the bottom left corner of the door 121 contacts the lower side of frame 115. Although the upper portions of frame 115 sway, the lower portions remain stationary within the foundation. Thus, the lower frame 115 provides a strong structure to resist any further horizontal movement of the door 121.

Once the frame 115 simultaneously contacts the brackets 141 at opposite (upper right and lower left) corners of the door 121, the door frame 115 is structurally supported by the compression and shear strength of the door 121. The door 121 transfers the force diagonally in shear across to the lower left corner which stops against the lower left side of frame 115 to help further resist the inward movement of the right side of frame 115. Thus, the upper left and lower right brackets 141 strengthen the door frame 115 as it sways right. As discussed, the shear forces are transferred through the hinges 125 in FIG. 3 across the door 121. The door 121 may also be strengthened by diagonal tension members 129 that is attached to the upper left and lower right corners of the door 121. As the upper panels are moved left, the force attempts to tilt the door 121 to the left making it a parallelogram. This movement causes the diagonal member 129 shown in FIG. 3 to be pulled tight and resist the side movement and strengthening the door frame 115.

The movement of earthquakes is cyclical and after the left movement the earthquake will cause the garage door frame 115 to move in the opposite direction towards the right and a similar sequence of events will occur. The frame 115 will sway inward and contact the bracket 141 mounted on the upper left side of the door 121. The door 121 may then slide to the right and the bracket 141 mounted to the lower right side of the door 121 may contact the lower right side of frame 115. The upper right and lower left brackets 141 strengthen the door frame 115 as it sways left. By resisting shear forces, the inventive bracket system improves the strength of the garage structure during an earthquake.

In another embodiment, the brackets have a different design that includes a coupling mechanism that helps to keep the garage door 121 from lifting up as forces are applied horizontally within the plane of the door frame 115 during an earthquake. This feature is important because the garage door 121 can only strengthen the door frame 115 if the door 121 remains in its fully closed position within the plane of the door frame 115 during the earthquake. If the door 121 lifts or becomes misaligned with the frame 115 during an earthquake, the garage structure will be weakened at the door area.

There are various coupling mechanisms that can be used to reduce uplift of the door 121 with the frame 115.

The coupling mechanisms may be passive or active devices. A passive device will couple the door 121 to the frame 115 in response to the earthquake movement and then disengage the door 121 after the earthquake has ended. An active device senses or responds to early earthquake forces and actuates a coupling mechanism to lock the door 121 to the frame 115. When the earthquake has ended, the active device may automatically disengage the coupling mechanisms or may require the mechanisms to be manually reset.

Figure 6:
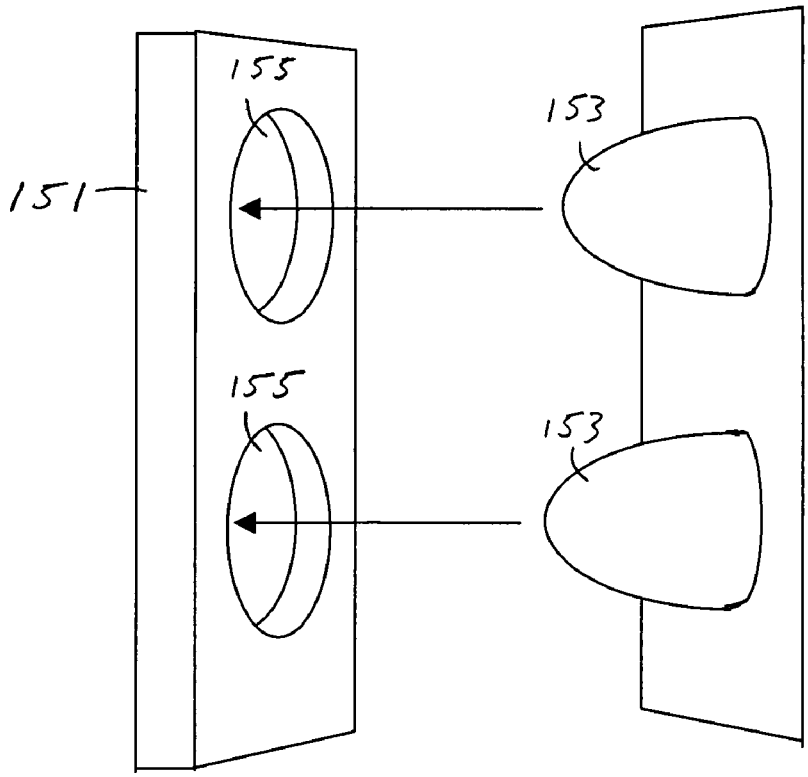
FIG. 6 illustrates door frame protrusions and corresponding bracket with holes.
Figure 7:
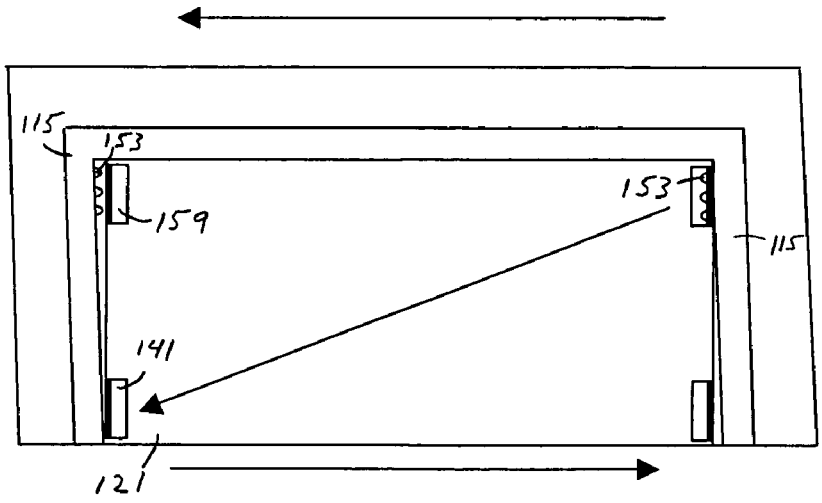
FIG. 7 illustrates a panel or sectional door with frame protrusions and brackets.

With reference to FIGS. 6 and 7, the passive coupling mechanism 151 may include a plurality of horizontally aligned protrusions 153 that engage holes 155 in the L brackets 159 mounted at the upper corners of the door. As discussed above, during an earthquake, the frame 115 sways towards the door 121 and contacts the bracket 159. In this embodiment, one or more tapered protrusions 153 will engage the holes 155 in the brackets 159 coupling the upper right corner of the door 121 to the door frame 115. This coupling keeps the door 121 from uplifting within the door frame 115. If the door 121 lifts within the door frame 115 during an earthquake, the door 121 does not add full structural strength. As the frame 115 sways in the opposite direction, frame 115 sways towards the door 121 and the protrusions 153 on the left side engage the holes 155 in the upper left bracket 159. This opposite motion also causes the right side of frame 115 to sway away from the door 121 and the protrusions 153 disengage from the holes 155 in the bracket 159. Thus, the coupling mechanisms in the upper right corners engage and disengage throughout the earthquake. Eventually, the earthquake will stop and both coupling mechanisms 153, 159 will disengage so that the door 121 can be opened.

The protrusion 153 may be tapered so that it will engage the hole 155 more easily. As the frame 115 moves closer towards the door 121, the hole 155 will slide down to a wider and stronger portion of the protrusion 153. The hole 155 and protrusion 153 may have corresponding shapes, such as circular or rectangular cross sections. In other embodiments, the protrusions 153 are uniform in cross section rather than tapered. The corresponding shapes provide a larger contact area than mismatched shapes, i.e. a round protrusion engaging a square hole. However, it is contemplated that mismatched protrusions and holes will also provide the described functionality.

There are various options for the lower corners of the door 121 when used with the upper protrusion 153 and hole 155 in L bracket 159 configuration. In one embodiment, there are no protrusions extending from the lower corners of the frame 115, the door 121 slides horizontally and the simple planar bracket 141 shown in FIG. 5 contacts the door frame 115 which prevents further horizontal movement.

In yet another embodiment, there are no brackets at the lower corner of the door.

Figure 8:
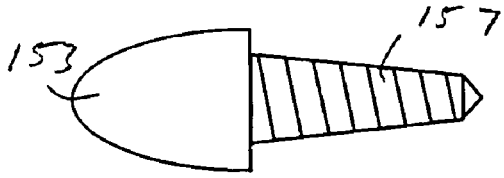
FIG. 8 illustrates a protrusion with a screw end.

There are many ways in which to attach the protrusions 153 to the door frame 115. With reference to FIG. 8, a screw 157 may be attached to the opposite end of the protrusion 153. The protrusion 153 may have parallel flat surfaces on the sides which allow a wrench to be used to screw the protrusion 153 into the frame. Alternatively, a screw (straight, Philips slot, etc.) or wrench fitting (Allen, star hole, etc.) may be machined into the exposed tip of the protrusion 153. Thus, each individual protrusion 153 can be individually mounted in the door frame 115. Because the screw 157 should be fully inserted into the frame 115, the cross section of the protrusion is preferably circular to avoid any misalignment problems.

Figure 9:
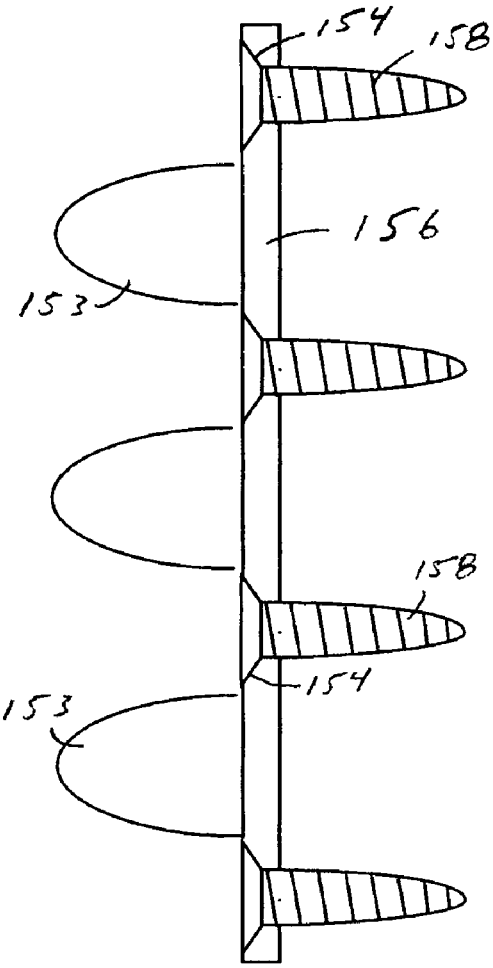
FIG. 9 illustrates a plate having a plurality of protrusions.

Alternatively, as illustrated in FIG. 9, a plurality of protrusions 153 are mounted to a single plate 156. The plate 156 has a plurality of holes 154 that are used to attach the plate 156 to the frame 115 using screws 158 or any other suitable fasteners. This plate 156 configuration may be stronger and more resistant to shear forces because the forces are distributed over a larger area and more mounting screws. Although the protrusions 153 are illustrated as being attached to the frame 115, it is also possible to reverse the configuration by mounting the protrusions 153 to the extended surface 148 of bracket 141 that is attached the door 121. In this embodiment, the frame 115 has the corresponding holes 155 which engage the protrusions 153.

Figure 10:
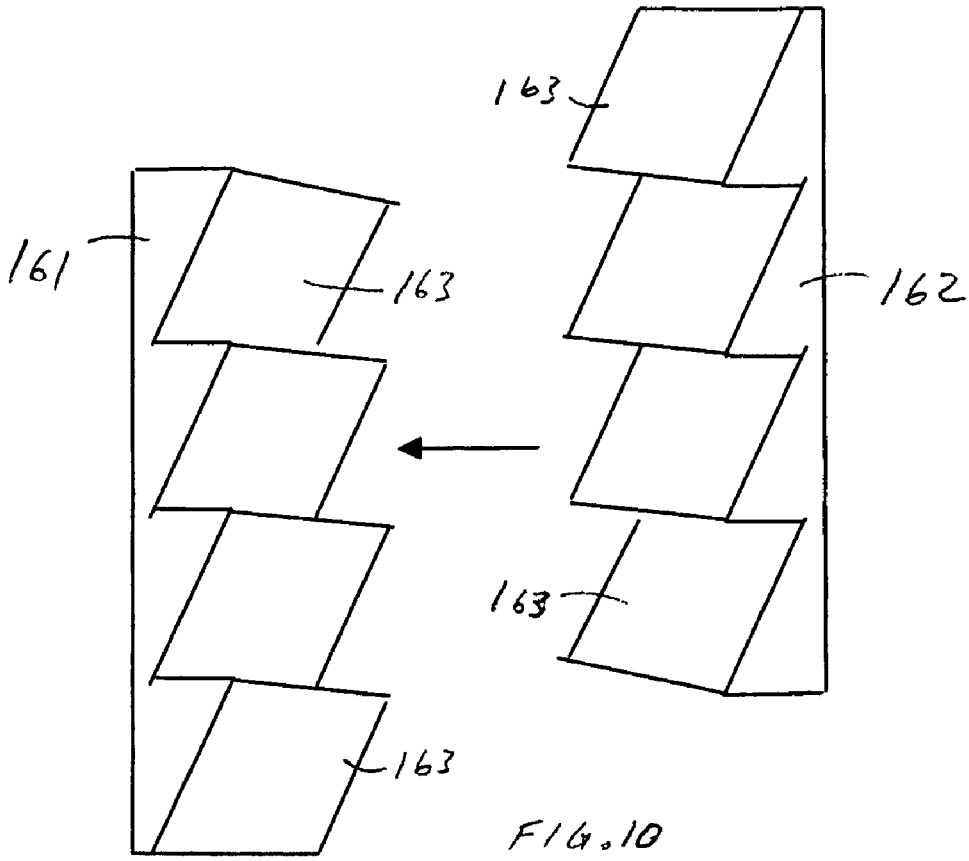
FIG. 10 illustrates a door plate and a frame plate having ramped surfaces.
Figure 11:
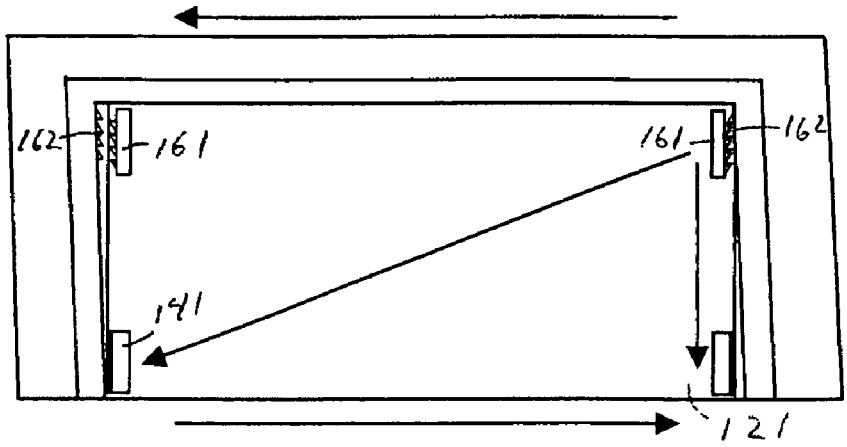
FIG. 11 illustrates a panel or sectional door with ramped surface coupling mechanisms.

There are other passive coupling mechanisms in addition to protrusions and holes. For example with reference to FIGS. 10 and 11, the door 121 has a door brackets 161 and the frame 115 has a frame plates 162. Both the door brackets 161 and the frame plates 162 have ramped surfaces 163. The ramps 163 are configured to press the door 121 downward when the frame 115 sways towards the door 121. Thus, in FIG. 7, the ramped surfaces 163 of the door brackets 161 are angled upward and the ramped surfaces 163 are angled downward. The door brackets 161 is attached to the upper corners of the door 121 and the frame plates 162 are attached to the corresponding upper corners of the frame 115. When the door brackets 161 contacts the frame plate 162, the ramped surfaces 163 engage each other and prevent uplift of door 121. When the post 141 sways away from the door 121, the ramped surfaces 163 disengage freeing the door 121. The ramped surfaces 163 do not require the alignment to be as accurate as the protrusion and hole mechanism.

Figure 12:
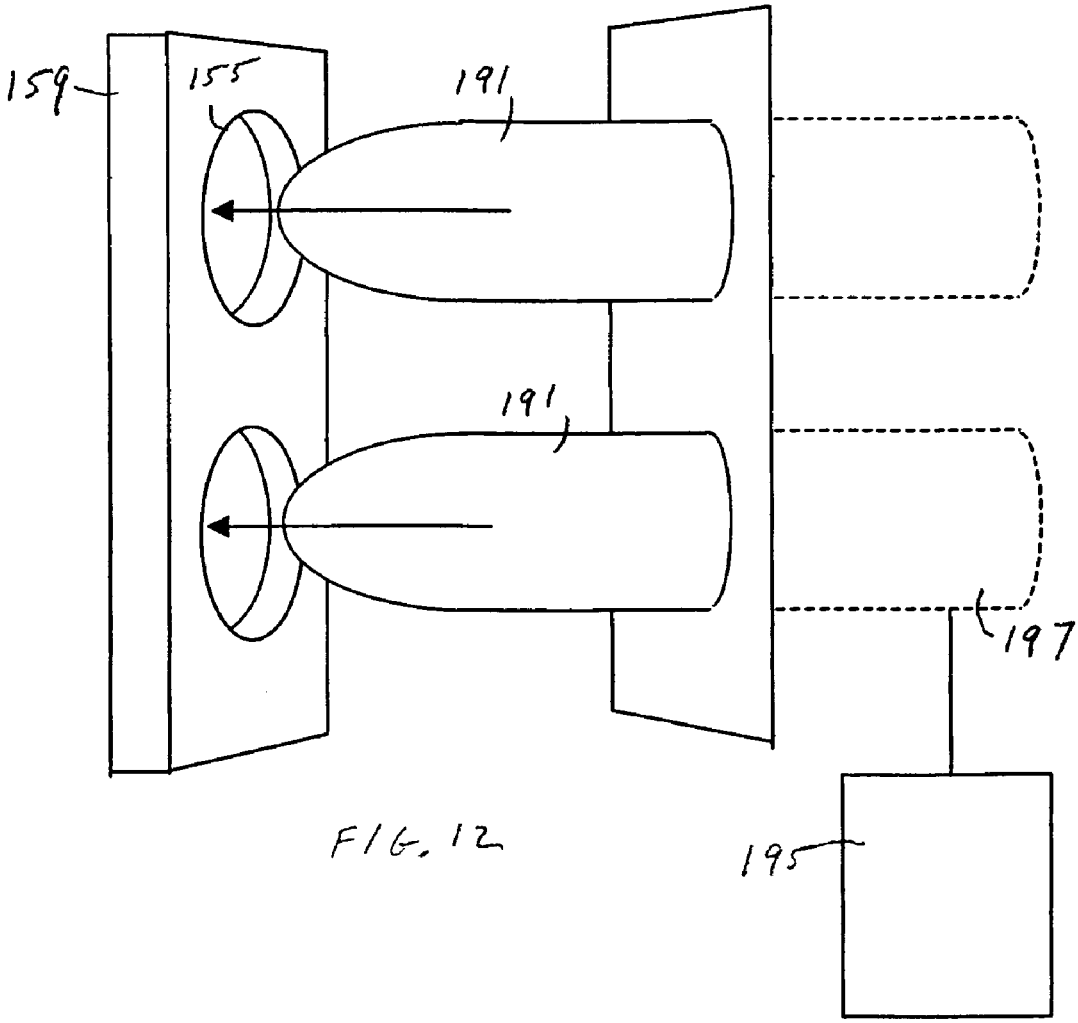
FIG. 12 illustrates an active coupling mechanism.
Figure 13:
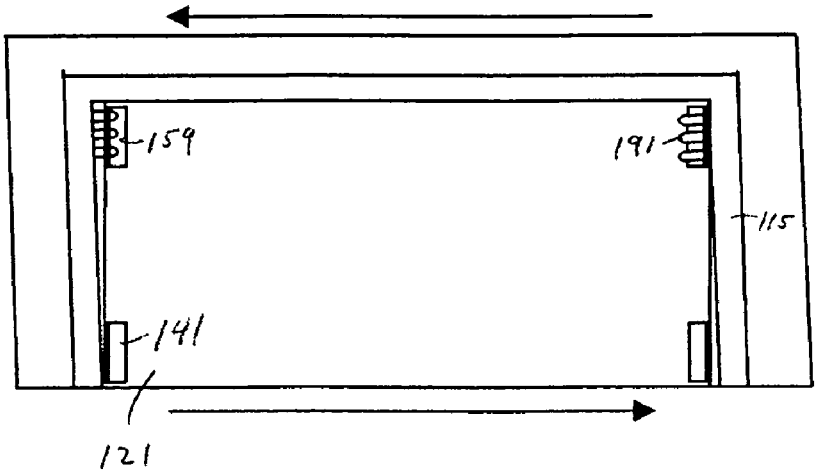
FIG. 13 illustrates a panel or sectional door with an active coupling mechanism.

As an alternative to passive coupling devices the inventive system may also be used with an active system. The active coupling mechanism requires the activation of a coupling mechanism. With reference to FIGS. 12 and 13, the active mechanism may have movable horizontally mounted rods 191 that are normally attached to or recessed within the door frame 115. The L brackets are the same as the brackets described above in FIG. 6. When an earthquake occurs, an actuator 197 extends the rods 191 on both sides of the frame inward to engage the holes in L brackets on both sides of the door 121. The actuator 197 may comprise a compressed spring, a solenoid or any other type of extending actuator mechanism may be used to extend the rods 191. The sensor 195 may be a motion detector that trips the actuators 197 when a specific earthquake magnitude is exceeded. Alternatively, the sensor 195 may trip the actuators 197 in response to receive earthquake actuation signals from a wired source or a radio wave signal. Since power may be lost during an earthquake, the sensor 195 and actuator 197 may run off of a rechargeable battery. Alternatively, the sensor 195 and actuator 197 may be pure mechanical devices that do not require electrical power.

The extended rods 191 remain engaged with the holes of the bracket throughout the earthquake as the frame side to side swaying movement of the frame 115. Because both sides of the door 121 are coupled to the frame 115, the active coupling embodiment provides the better structural support than the passive devices. Only after the earthquake has stopped may the rods 191 be retracted so that the door 121 can be opened. The retraction of the rods 191 may be through a manual reset. Although the active coupling mechanism has only been described with reference to movable rods 191, it is contemplated that various other coupling mechanisms may be used including: clamps, wedges, calipers, blocking or restraints at the top of the door or any other type of friction mechanism to prevent uplift of the door 121 with respect to the frame 115.

While the present invention has been described in terms of a preferred embodiment above, those skilled in the art will readily appreciate that numerous modifications, substitutions and additions may be made to the disclosed embodiment without departing from the spirit and scope of the present invention. It is intended that all such modifications, substitutions and additions fall within the scope of the present invention that is best defined by the claims below.

What is claimed is:

1. An apparatus in combination with a garage door frame and a garage door;

the frame consisting of a cross beam, a left post and a right post, wherein the posts and the cross beam define an opening for a garage door, the garage door having a front side facing towards the outside of a building and a back side facing towards the inside of the building, the apparatus comprising:

a first bracket that is mounted directly to a right side of the front side of the garage door, the first bracket having a substantially vertical planar surface that is positioned directly between and parallel to the posts of the garage door frame; and a second bracket that is mounted directly to a left side of the front side of the garage door, the second bracket having a substantially vertical planar surface that is positioned directly between and parallel to the posts of the garage door frame, wherein the first bracket and the second bracket contact the right post and left post respectively when an inward deflection of the right post or left post occurs, thereby resisting movement of the posts.

2. The apparatus of claim 1 wherein the first bracket and the second bracket are "L" brackets having a first planar portion that is perpendicular to a second planar portion.

3. The apparatus of claim 1 wherein the first bracket is mounted on a top right side of the garage door and the second bracket is mounted on a top left side of the garage door.

4. The apparatus of claim 2 further comprising:

a plurality of fasteners used to mount the first bracket to the garage door.

5. An apparatus in combination with a garage door frame and a garage door;

the frame consisting of a cross beam, a left post and a right post, wherein the posts and the cross beam define an opening for a garage door, the garage door having a front side facing towards the outside of a building and a back side facing towards the inside of the building, the apparatus comprising:

an upper right bracket that is mounted directly to a right side of the front side of the garage door, the upper right bracket having a substantially vertical planar surface that is positioned directly between and parallel to the posts of the garage door frame; and an upper left bracket that is mounted directly to a left side of the front side of the garage door, the upper left bracket having a substantially vertical planar surface that is positioned directly between and parallel to the posts of the garage door frame; and a lower right bracket that is mounted directly to a lower right side of the front side of the garage door, the lower right bracket having a substantially vertical planar surface that is positioned directly between and parallel to the posts of the garage door frame; and a lower left bracket that is mounted directly to a lower left side of the front side of the door having a substantially vertical planar surface that is positioned directly between and parallel to the posts of the garage door frame;

wherein the upper right bracket and the lower right bracket contact the right post while the upper left bracket and the lower left bracket contact the left post when an inward deflection of the right post or left post occurs, thereby resisting the inward deflection of the right and left posts.

6. The combination of claim 5 further comprising:

a first coupling device mounted on a right side of the garage door frame, the first coupling device transmits vertical forces to the garage door when the first coupling device engages the upper right bracket; and a second coupling device mounted on a left side of the garage door frame, the second coupling device transmits vertical forces to the garage door when the second coupling device engages the upper left bracket.

7. The combination of claim 6, wherein the substantially vertical planar surface of the upper right bracket has ramps that engage with corresponding ramp features on the first coupling device, and the upper left bracket has ramps that engage with corresponding ramp features on the second coupling device.

8. The combination of claim 5, wherein the upper right bracket and the upper left bracket are "L" brackets having a first planar portion that is perpendicular to a second planar portion.

9. The combination of claim 5, wherein the substantially vertical planar surface of the upper right bracket has one or more holes that engage one or more protrusions attached to a right side of the door frame, and the substantially vertical planar surface of the upper left bracket has one or more holes that engage one or more protrusions attached to a left side of the frame.

10. The combination of claim 9, wherein the one or more protrusions attached to the right side of the frame and the one or more protrusions attached to the left side of the frame are tapered elongated rods.

11. The combination of claim 9, wherein the one or more protrusions attached to the right side of the door frame are moveable between a first retracted position and a second extended position, and the one or more protrusions attached to the left side of the door frame are moveable between a first retracted position and a second extended position.

* * * * *